US011049429B2

(12) United States Patent
Kang

(10) Patent No.: US 11,049,429 B2
(45) Date of Patent: Jun. 29, 2021

(54) ELECTRONIC DEVICE FOR BLENDING LAYER OF IMAGE DATA

(71) Applicant: SAMSUNG ELECTRONICS CO., LTD., Suwon-si (KR)

(72) Inventor: Sung-Rae Kang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/821,254

(22) Filed: Mar. 17, 2020

(65) Prior Publication Data

US 2021/0027685 A1 Jan. 28, 2021

(30) Foreign Application Priority Data

Jul. 23, 2019 (KR) ..... 10-2019-0089104

(51) Int. Cl.
*G09G 3/20* (2006.01)

(52) U.S. Cl.
CPC ..... *G09G 3/20* (2013.01); *G09G 2340/10* (2013.01); *G09G 2360/127* (2013.01)

(58) Field of Classification Search
CPC combination set(s) only.
See application file for complete search history.

(56) References Cited

U.S. PATENT DOCUMENTS

| | | | |
|---|---|---|---|
| 7,630,577 | B2 | 12/2009 | Yi et al. |
| 9,087,409 | B2 | 7/2015 | Gruber |
| 9,262,841 | B2 | 2/2016 | Toth |
| 10,121,222 | B2 | 11/2018 | Chen et al. |
| 2017/0309214 | A1* | 10/2017 | Park ..... G09G 3/2003 |
| 2018/0330468 | A1 | 11/2018 | Mao |

FOREIGN PATENT DOCUMENTS

| | | |
|---|---|---|
| JP | 2000-305546 | 11/2000 |
| JP | 2008-305030 | 12/2008 |

* cited by examiner

*Primary Examiner* — Deeprose Subedi
(74) *Attorney, Agent, or Firm* — F. Chau & Associates, LLC

(57) ABSTRACT

An electronic device that includes a memory and a plane circuit is described. The memory outputs a first alpha data value and a first pixel data value, then outputs a second alpha data value and a second pixel data value, then stores a third pixel data value. The plane circuit outputs a request signal for the third pixel data value, based on whether the first alpha data value and the second alpha data value are equal to a reference value and whether the first pixel data value corresponds to the third pixel data value.

20 Claims, 8 Drawing Sheets

ELECTRONIC DEVICE FOR BLENDING LAYER OF IMAGE DATA

CROSS-REFERENCE TO RELATED APPLICATIONS

This application claims priority under 35 U.S.C. § 119 to Korean Patent Application No. 10-2019-0089104 filed on Jul. 23, 2019, in the Korean Intellectual Property Office, the disclosures of which are incorporated by reference herein in their entireties.

BACKGROUND

Embodiments of the inventive concept described herein relate to an electronic device, and more particularly, to an electronic device for processing image data.

Electronic devices, such as smartphones and televisions, often include a display device. A display device is used to provide information to a user in the form of an image. As communication technologies progress, display devices display images that include more information (e.g., using more pixels).

Display devices include numerous electronic circuits. These circuits perform a variety of function related to processing images. As the amount of information processed by an electronic device increases, more circuits are needed. In some cases, increasing the number of circuits improves the performance of the display device.

However, increased performance of a display device may lead to higher power consumption and increased processing times for image calculations. Therefore, there is a need in the art for components of a display device that consume less power and reduce processing time.

SUMMARY

Embodiments of the inventive concept provide an electronic device configured to analyze data values associated with transparency of image layers and to blend the image layers based on the analyzed data values.

According to an exemplary embodiment, an electronic device may include a memory and a plane circuit. The memory may output a first alpha data value and a first pixel data value rendered for a first frame of a first display region, may output a second alpha data value and a second pixel data value rendered for the first frame of a second display region, and may store a third pixel data value rendered for a second frame of the first display region. The plane circuit may determine whether the first alpha data value and the second alpha data value are equal to a reference value and whether the first pixel data value corresponds to the third pixel data value, and output a request signal for the third pixel data value based on the determination. The electronic device may also include a display panel configured to display an image based at least in part on the determination.

According to an exemplary embodiment, an electronic device may include a memory and a plane circuit. The memory may output a first alpha data value and a first pixel data value rendered for a first frame of a first display region, may output a second alpha data value and a second pixel data value rendered for the first frame of a second display region, and may store a third pixel data value rendered for a second frame of the first display region. The plane circuit may output an image layer including the third pixel data value, based on whether the first alpha data value and the second alpha data value are equal to a reference value. The first alpha data value, the first pixel data value, the second alpha data value, and the second pixel data value may be output in response to one request signal. The electronic device may also include a display panel configured to display an image based at least in part on the image layer.

According to an exemplary embodiment, an electronic device may include a processing engine, a memory, and a plane circuit. The processing engine may render first alpha data values and first pixel data values for a first frame of a target display region and may render second alpha data values and second pixel data values for a second frame of the target display region. The memory may output the first alpha data values and the first pixel data values in response to a first request signal and may output the second alpha data values and the second pixel data values in response to a second request signal. In a first time period, the plane circuit may output the first request signal for requesting the first alpha data values and the first pixel data values in a first time period, and output the second request signal in a second time period after the first time period when the first alpha data values are equal to a reference value. The electronic device may further include a display panel configured to display an image based at least in part on the first request signal, the second request signal, or both.

According to another exemplary embodiment, a method of displaying images includes receiving a first alpha data value, a first pixel data value, a second alpha data value and a second pixel data value from a memory; determining whether the first alpha data value and the second alpha data value are equal to a reference value; transmitting a request signal to the memory based on the determination, where the request signal indicates a request for a third pixel data value; and generate one or more image layers based on the first alpha data value, the first pixel data value, the second alpha data value, the second pixel data value, the third pixel data value, or any combination thereof.

BRIEF DESCRIPTION OF THE FIGURES

The above and other objects and features of the inventive concept will become apparent by describing in detail exemplary embodiments thereof with reference to the accompanying drawings.

DETAILED DESCRIPTION

According to an embodiment of the inventive concept, a display driver communicates with a memory device. The memory may store rendered image data (e.g., aRGB data), and may communicate the data to the display driver for processing. The display driver may also include an alpha data analyzer to analyze alpha data included in the image data.

The alpha data is associated with transparency of an image. When the result of the alpha analyzer indicates that the alpha data values correspond to a specific reference value (e.g., the alpha values are zero), the display driver does not request further image data from the memory. Eliminating unnecessary image data requests reduces power and processing time involved in communication between the memory and the display driver.

Embodiments of the inventive concept may be described in detail and clearly to such an extent that one of ordinary skill in the art easily implements the inventive concept.

Figure 1:
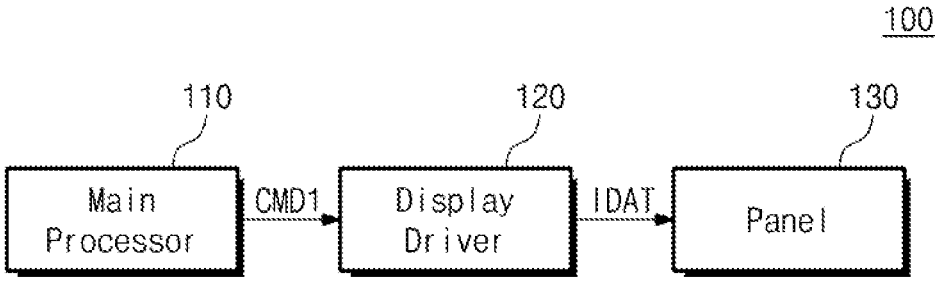
FIG. 1 is a block diagram illustrating an exemplary configuration of an electronic device according to an embodiment of the inventive concept.

FIG. 1 is a block diagram illustrating an exemplary configuration of an electronic device according to an embodiment of the inventive concept.

Referring to FIG. 1, an electronic device 100 may include a main processor 110, a display driver 120, and a panel 130. For example, the electronic device 100 may be implemented with a data processing device that may be able to use or support an interface protocol presented by the MIPI alliance.

For example, the electronic device 100 may be one of electronic devices such as a portable communication terminal, a personal digital assistant (PDA), a portable media player (PMP), a smartphone, a tablet computer, and a wearable device. Additionally, the electronic device 100 may be one of various types of display devices configured to provide image information to the user, like the digital television (DTV).

The main processor 110 may control/manage operations of the components of the electronic device 100. For example, the main processor 110 may be implemented with a general-purpose processor, a special-purpose processor, or an application processor. For example, the main processor 110 may include one processor core (e.g., a single core). Additionally, the main processor 110*n* may include a plurality of processor cores (e.g., a multi-core such as a dual-core, a quad-core, or a hexa-core).

For example, the main processor 110 may include a dedicated circuit (e.g., field-programmable gate arrays (FPGA) or application-specific integrated circuits (ASICs)). Additionally, the main processor 110 may include a system on chip (SoC), which includes one or more processor cores. For example, the electronic device 100 may further include a cache memory that may be placed inside or outside the main processor 110.

The main processor 110 may process data associated with an image such that the main processor 110 may process data indicating information of an image to be provided to the user. For example, the electronic device 100 may process data indicating information of various types of images, such as information of an image/video obtained by an image sensor and information of an image/video obtained through a communication device.

FIG. 1 shows the main processor 110 may generate a command signal CMD1 for controlling the display driver 120 to provide image information to the user. The main processor 110 may output the command signal CMD1 associated with the image information to the display driver 120.

The command signal CMD1 may be associated with a certain scenario for providing the image information to the user. For example, the user may input a command to the main processor 110 to request a certain image. The main processor 110 may generate the command signal CMD1 to provide an image corresponding to the request of the user. For example, the main processor 110 may generate the command signal CMD1 to provide an image, which varies depending on a time, in response to the request of the user.

The display driver 120 may receive the command signal CMD1 from the main processor 110. The display driver 120 may generate image layers indicating an image in response to the command signal CMD1. The display driver 120 may blend the image layers to generate image data. The display driver 120 may output a signal IDAT indicating the image data to the panel 130.

For example, the panel 130 may include a pixel array including a plurality of pixels and a driver circuit for operating the pixel array. For example, the panel 130 may be implemented with at least one of various types of display structures such as a liquid crystal display (LCD), a light-emitting diode (LED), an organic light-emitting diode (OLED), and a quantum dot light-emitting diode (QLED). The driver circuit of the panel 130 may include various types of electronic circuits for an operation of the pixel array.

The panel 130 may receive the signal IDAT from the display driver 120. The panel 130 may display an image corresponding to image data based on the signal IDAT. The panel 130 may display an image to provide image information to the user.

Figure 2:
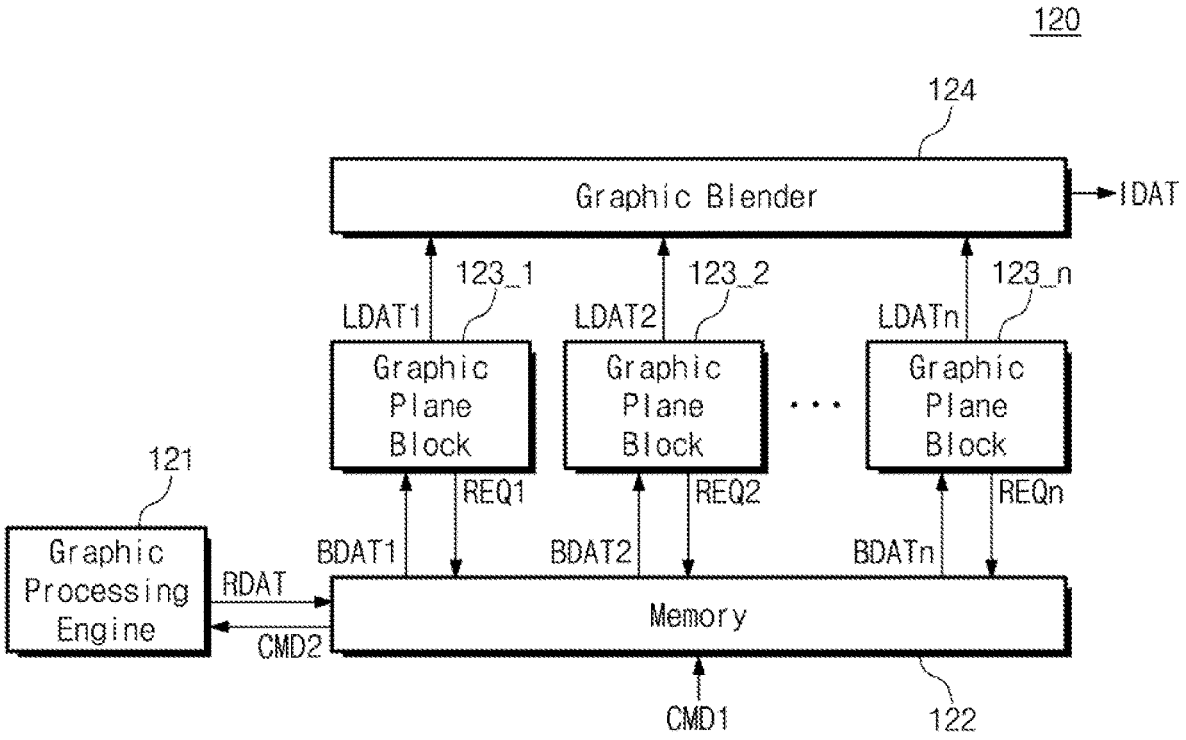
FIG. 2 is a block diagram illustrating an exemplary configuration of a display driver of FIG. 1.

FIG. 2 is a block diagram illustrating an exemplary configuration of a display driver of FIG. 1.

Referring to FIG. 2, the display driver 120 may include a graphic processing engine 121, a memory 122, graphic plane blocks 123_1 to 123_*n*, and a graphic blender 124.

The graphic processing engine 121, the memory 122, the graphic plane blocks 123_1 to 123_*n*, and the graphic blender 124 may be implemented with one or more hardware devices.

For example, each of the graphic processing engine 121, the memory 122, the graphic plane blocks 123_1 to 123_*n*, and the graphic blender 124 may be implemented with a hardware circuit (e.g., an analog circuit and a logic circuit) to perform operations to be described below.

Alternatively, for example, the graphic processing engine 121, the memory 122, the graphic plane blocks 123_1 to 123_*n*, and the graphic blender 124 may be implemented with a program code to perform specific operations. Additionally, the graphic processing engine 121, the memory 122, the graphic plane blocks 123_1 to 123_*n*, and the graphic blender 124 may be executed by one of various types of processing devices such as a general-purpose processor, a workstation processor, or an application processor.

For example, the graphic processing engine 121, the memory 122, the graphic plane blocks 123_1 to 123_*n*, and the graphic blender 124 may include a dedicated circuit (e.g., field-programmable gate arrays (FPGA) or application-specific integrated circuits (ASICs)). Additionally, the graphic processing engine 121, the memory 122, the graphic plane blocks 123_1 to 123_*n*, and the graphic blender 124 may include a system on chip (SoC), which includes one or more processor cores.

For example, the memory 122 may include a volatile memory, such as a static random access memory (SRAM), a dynamic RAM (DRAM), or a synchronous DRAM (SDRAM), and/or a non-volatile memory, such as a flash memory, a phase-change RAM (PRAM), a magneto-resistive RAM (MRAM), a resistive RAM (ReRAM), or a ferro-electric RAM (FRAM).

The memory 122 may receive the command signal CMD1 from the main processor 110. The memory 122 may store data of a command generated by the main processor 110 based on the command signal CMD1. The memory 122 may generate a command signal CMD2 indicating the data of the command transferred from the main processor 110. The memory 122 may output the command signal CMD2 to the graphic processing engine 121.

The graphic processing engine 121 may receive the command signal CMD2 from the memory 122. The graphic processing engine 121 may perform rendering of an image to be displayed by the panel 130 in response to the command signal CMD2. For example, the graphic processing engine 121 may output the signal RDAT to render images displayed by the panel 130.

For example, image data of the signal RDAT may indicate image layers such that the image data of the signal RDAT may indicate image layers to be transferred to the graphic plane blocks 123_1 to **123_*n*, respectively. Each of the image layers may be rendered in the unit of frame. For example, the number of frames to be rendered at the memory 122 may be determined based on the usage scenario indicated by the command signal CMD2**.

The graphic processing engine 121 may output the signal RDAT to the memory 122. The memory 122 may store the rendered image layers based on the signal RDAT. The memory 122 may generate image data respectively indicating the image layers to transfer the rendered image layers. The memory 122 may generate signals BDAT1 to BDATn, respectively, indicating the image data of the image layers.

The graphic plane blocks 123_1 to **123_*n* may request image data from the memory 122 to generate image layers. The graphic plane blocks 123_1 to 123_*n* may output signals REQ1 to REQn to the memory 122 to request image data. The memory 122 may respectively output the signals BDAT1 to BDATn to the graphic plane blocks 123_1 to 123_*n* in response to the signals REQ1** to REQn.

Image data of each of the signals BDAT1 to BDATn may include alpha data associated with the transparency of an image and pixel data associated with physical values of the image. The alpha data and the pixel data may constitute one data block. An image indicated by one data block may correspond to an image to be displayed in a certain region of the panel 130. For example, an image indicated by one data block may correspond to an image to be displayed by one pixel of the panel 130.

A plurality of data blocks may constitute one data burst. The number of data blocks included in the data burst may be associated with channel widths for communication between the memory 122 and the graphic plane blocks 123_1 to **123_*n*. For example, one data block may include 8-bit alpha data and 24-bit pixel data (i.e., a total of 32-bit data). Additionally, each of channel widths between the memory 122 and the graphic plane blocks 123_1 to 123_*n*** may be 32 bits.

In this case, 4 data blocks constituting one unit (hereinafter referred to as a "data burst") may be conveyed between each of the graphic plane blocks 123_1 to **123_*n* and the memory 122. One data burst may include 4 data blocks. An example of image data organized in the form of a data burst will be more fully described with reference to FIG. 3**.

The graphic plane blocks 123_1 to **123_*n*, respectively, may obtain image data corresponding to image layers based on the signals BDAT1 to BDATn. Each of the graphic plane blocks 123_1 to 123_*n* may generate an image layer based on image data. Each of the image layers may have transparency corresponding to alpha data and a pixel value. For example, corresponding transparency may refer to a brightness value or an RGB color value. The graphic plane blocks 123_1 to 123_*n* may respectively output signals LDAT1 to LDATn indicating the image layers to the graphic blender 124**.

The graphic blender 124 may receive the signals LDAT1 to LDATn from the graphic plane blocks 123_1 to **123_*n*. The graphic blender 124 may obtain image layers based on the signals LDAT1 to LDATn. The graphic blender 124** may blend the obtained image layers.

The graphic blender 124 may generate image data indicating a combined image. The graphic blender 124 may output the signal IDAT indicating image data of the combined image to the panel 130. As described with reference to FIG. 1, the panel 130 may display an image based on the signal IDAT. Exemplary operations of the graphic blender 124 will be more fully described with reference to FIG. 4.

Figure 3:
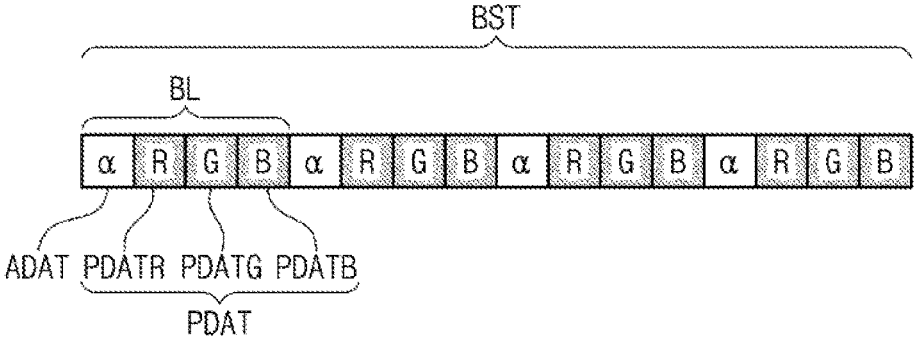
FIG. 3 is a conceptual diagram illustrating an exemplary configuration of image data of FIG. 1.

FIG. 3 is a conceptual diagram illustrating an exemplary configuration of image data of FIG. 1.

Below, image data indicated by one of the signals BDAT1 and BDAT2 is referred to as "BDAT", one of alpha data respectively included in the signals BDAT1 and BDAT2 is referred to as "ADAT", and one of pixel data respectively included in the signals BDAT1 and BDAT2 is referred to as "PDAT".

For example, the image data BDAT may be organized based on an aRGB format. However, the image data BDAT may be organized based on one of various kinds of formats such as RGBa, BGRa, aBGR, and aYUV. The pixel data PDAT may include pixel data PDATR corresponding to a red color, pixel data PDATG corresponding to a green color, and pixel data PDATB corresponding to a blue color.

The alpha data ADAT and the pixel data PDAT may constitute the data block BL. In the example of FIG. 3, 4 data blocks, including the data block BL, may constitute the data burst BST. As described with reference to FIG. 2, the number of data blocks included in the data burst BST may be associated with a width of a channel for communication between each of the graphic plane blocks 123_1 to **123_*n* and the memory 122**.

For example, data blocks included in one data burst may be output through a channel substantially at the same time. Alternatively, the memory 122 may output the data blocks of the data burst such that the data blocks match when data blocks included in one data burst are not output at the same time. Accordingly, the memory 122 may output data blocks matched as a data burst in response to one signal (e.g., one of the signals REQ1 to REQn). Additionally, the graphic plane blocks 123_1 to **123_*n*** may process the matched data blocks in the unit of data burst.

Figure 4:
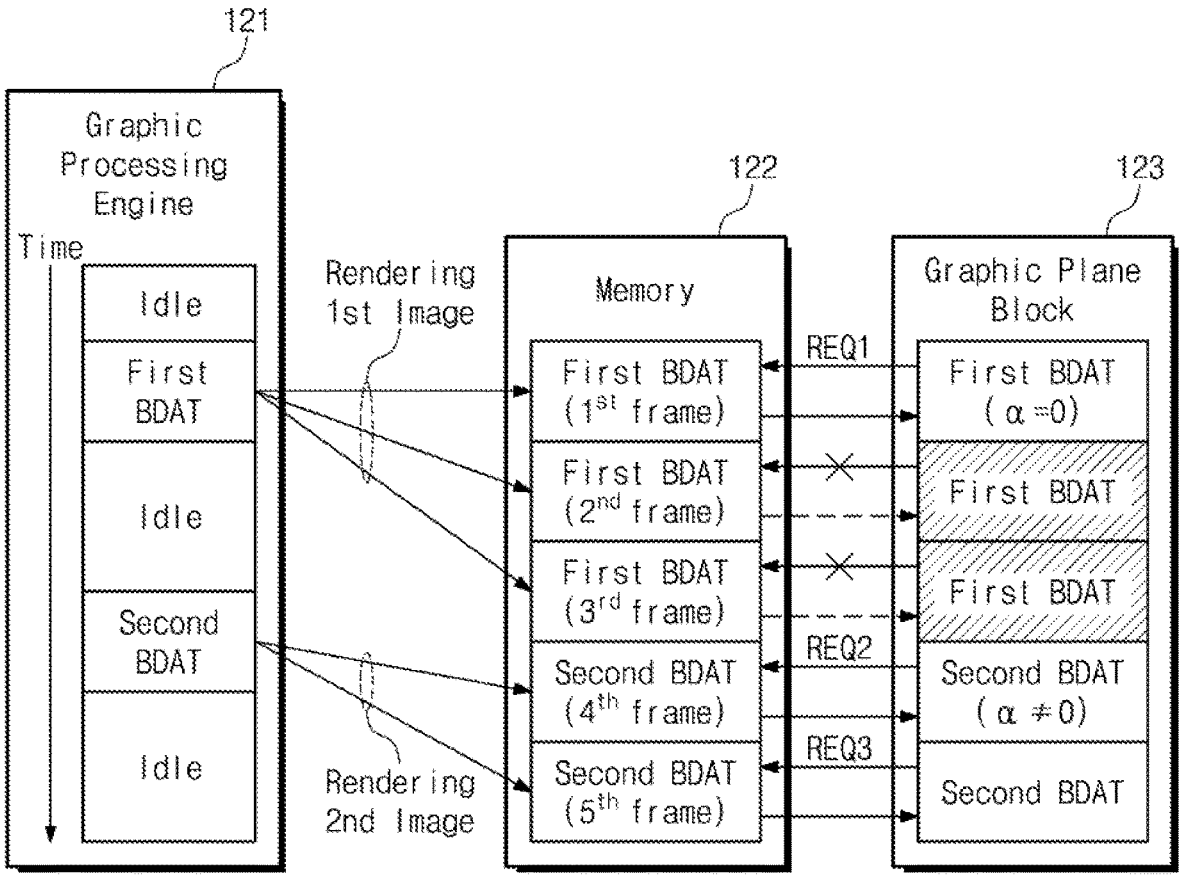
FIG. 4 is a conceptual diagram for describing exemplary operations of a display driver of FIG. 1.

FIG. 4 is a conceptual diagram for describing exemplary operations of a display driver of FIG. 1. Each of the graphic plane blocks 123_1 to **123_*n* of FIG. 2 may include a graphic plane block 123 of FIG. 4**.

The rendering of the graphic processing engine 121 may be performed in the unit of frame. For example, in a case where one data block corresponds to an image to be displayed by one pixel included in the panel 130, a data burst including "K" data blocks may correspond to an image to be displayed by a display region corresponding to "K" pixels.

For example, a rendering operation associated with image data included in one data burst from among image data constituting one frame will be described below. However, frame may be expressed by a plurality of data bursts and each of the plurality of data bursts may be rendered depending on a method similar to the method described with reference to FIG. 3.

In the example of FIG. 4, the graphic processing engine 121 may sequentially render image data "first BDAT" and image data "second BDAT" to the memory 122 over time, in response to the command signal CMD received from the main processor 110. For example, the graphic processing engine 121 of an idle state may render the image data "first BDAT" to the memory 122 and may again enter the idle state. The graphic processing engine 121 may render the image data "second BDAT" to the memory 122 and may again enter the idle state.

The image data "first BDAT" and the image data "second BDAT" may be respectively associated with images of different frames, which are to be displayed by a certain display region of the panel 130. The graphic processing engine 121 may determine the number of frames corresponding to each image data based on the command signal CMD2. In the example of FIG. 4, the number of frames of the image data "first BDAT" may be determined to be "3", and the number of frames of the image data "second BDAT" may be determined to be "2".

Data values may correspond to a number of frames. The graphic processing engine 121 may render the data values to a certain memory region of the memory 122 such that an image of the image data "first BDAT" and an image of the image data "second BDAT" are displayed during a time determined based on the command signal CMD2. The time may correspond to the number of frames. For example, the command signal CMD2 may indicate the number of frames corresponding to certain image data in compliance with a certain scenario (i.e., a command of the user input through a user interface) such as a usage pattern of the user.

For example, regarding a first frame to a fifth frame to be displayed sequentially by the panel 130 over time, image data "first BDAT" corresponding to the first frame to the third frame may be rendered to a first memory region of the memory 122. Additionally, the image data "second BDAT" corresponding to the fourth frame and the fifth frame may be rendered to a second memory region of the memory 122.

The graphic processing engine 121 may store data indicating whether an image to be displayed by the panel 130 changes at any frame in the memory 122. In the example of FIG. 4, when a frame changes from the third frame to the fourth frame, image data to be rendered may change from the image data "first BDAT" to the image data "second BDAT".

For example, the graphic processing engine 121 may generate data (hereinafter referred to as "change notification data"), indicating that image data to be rendered changes after the third frame. The graphic processing engine 121 may match the change notification data with the image data "first BDAT" to be rendered at the third frame, and the memory 122 may store the change notification data matched with the image data "first BDAT".

The graphic plane block 123 may be provided with the change notification data matched with the image data "first BDAT" from the memory 122. In a first time period corresponding to the first frame, the graphic plane block 123 may output the signal REQ1 for requesting the image data "first BDAT" to be used to generate an image layer based on the change notification data. The memory 122 may output the image data "first BDAT" of the first memory region to the graphic plane block 123 in response to the signal REQ1.

The graphic plane block 123 may analyze alpha data values included in a data burst of the image data "first BDAT". In a specification, a reference value of alpha data may correspond to a maximum value of the transparency of an image to be displayed by the panel 130. For example, in a case where the alpha data are expressed by 8 bits, the alpha data may have one of values from "0" to "255". In a case where an alpha data value of "0" indicates the highest transparency and an alpha data value of "255" indicates the lowest transparency, the reference value of the alpha data may be "0".

For example, image data, including alpha data with the reference value, may correspond to a fully transparent image. Considering an image to be displayed finally by the panel 130, a state where an image is displayed based on image data including the alpha data of the reference value may be substantially equal to a state where an image is not displayed.

In the example of FIG. 4, alpha data values of the image data "first BDAT" may be the reference value. Accordingly, an image corresponding to the image data "first BDAT" may be fully transparent. Not to generate an image instead of generating a transparent image based on the image data "first BDAT", the graphic plane block 123 may not further request the image data "first BDAT". A signal may not be output from the graphic plane block 123 during a second time period (corresponding to the second frame) and a third time period (corresponding to the third frame) after the first time period (corresponding to the first frame).

The graphic plane block 123 may request the image data "second BDAT" from the fourth frame, based on the change notification data. Accordingly, during the fourth time period (corresponding to the fourth frame), the graphic plane block 123 may output the signal REQ2. The memory 122 may output a signal indicating the image data "second BDAT" to the graphic plane block 123 in response to the signal REQ2.

The graphic plane block 123 may analyze alpha data values included in a data burst of the image data "second BDAT". For example, at least one of the alpha data values of the image data "second BDAT" may not be the reference value. For example, at least a portion of an image corresponding to the image data "second BDAT" may not be transparent.

Because a part of the alpha data values included in the data burst does not have the reference value, the graphic plane block 123 may again request the image data "second BDAT" corresponding to the fifth frame after the fourth frame. Accordingly, the graphic plane block 123 may output the signal REQ3. In response the signal REQ3, the memory 122 may output, to the graphic plane block 123, a signal indicating the image data "second BDAT" to be displayed during a fifth time period (corresponding to the fifth frame) after the fourth time period.

Because signals for requesting the image data "first BDAT" with regard to the second frame and the third frame are not output by the graphic plane block 123, the number of times that a signal is output by the graphic plane block 123 to request image data may decrease. Additionally, the number of data bursts that are transferred from the memory 122 to the graphic plane block 123 may decrease. Accordingly, the complexity of operation of the display driver 120 may decrease, and power consumption of an electronic device including the display driver 120 may decrease.

Figure 5:
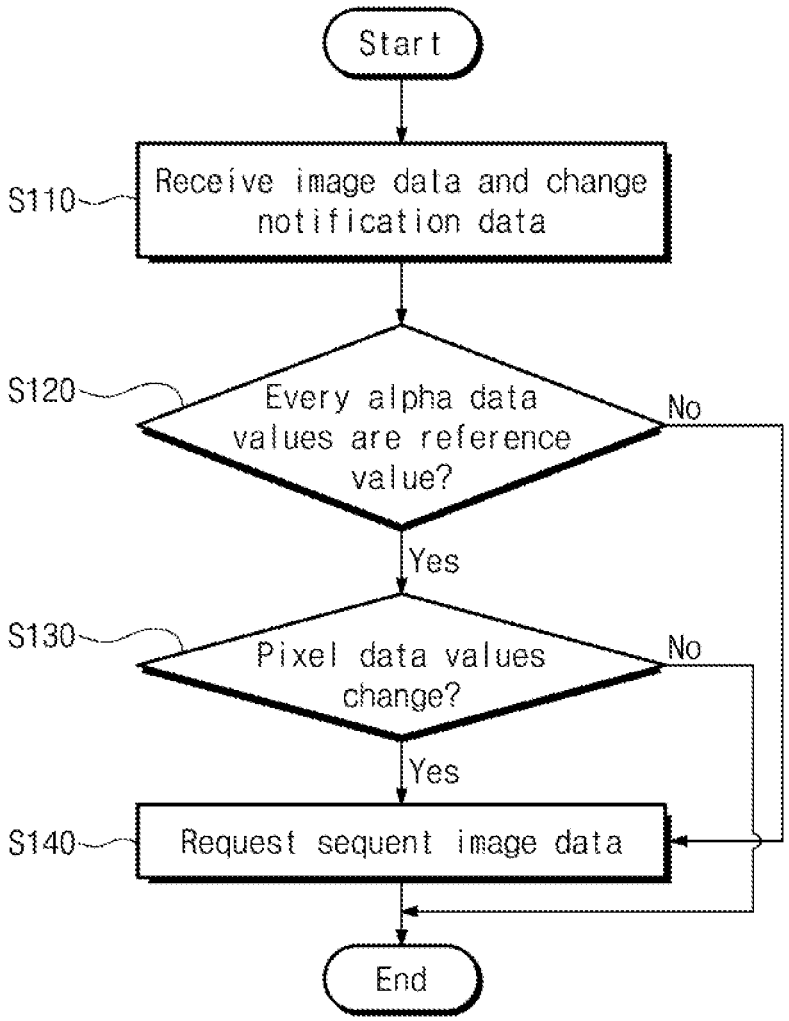
FIG. 5 is a flowchart illustrating exemplary operations of a graphic plane block of FIG. 4.

FIG. 5 is a flowchart illustrating exemplary operations of a graphic plane block of FIG. 4. Exemplary operations of the graphic plane block 123 for processing one data burst will be described with reference to FIG. 5, but the graphic plane block 123 may process a plurality of data bursts sequentially or simultaneously.

In operation S110, the graphic plane block 123 may output a signal for requesting image data and may receive image data and change notification data output in response to the signal. Referring to FIG. 4, the graphic plane block 123 may output the signal REQ1 for requesting the image data "first BDAT." The graphic plane block 123 may receive image data output from the memory 122 in response to the signal REQ1.

In operation S120, the graphic plane block 123 may analyze alpha data values included in the image data received in operation S110. For example, the graphic plane block 123 may determine whether the alpha data values included in the image data correspond to the reference value. Referring to FIG. 4, the graphic plane block 123 may determine whether the alpha data values included in the image data "first BDAT" are equal to the reference value.

When the alpha data values included in the image data are equal to the reference value, operation S130 may be performed. When at least one of the alpha data values included in the image data is not the reference value (e.g. if the lower value corresponds to the higher transparency, the alpha data value is greater than the reference value) operation S140 may be performed.

In operation S130, the graphic plane block 123 may determine whether there are changed pixel data to be received at a next frame with respect to the pixel data (i.e., current pixel data) received in operation S110, based on the change notification data received in operation S110. When pixel data of the next frame to be received from the memory 122 are different from the current pixel data, operation S140 may be performed. When the pixel data of the next frame to be received from the memory 122 are equal to the current pixel data, the operation of FIG. 5 may be terminated such that additional image data are not requested.

In operation S140, the graphic plane block 123 may output a signal to request image data of the next frame. Referring to FIG. 4, at the fourth frame following the third frame, the graphic plane block 123 may output the signal REQ2 for requesting the image data "second BDAT".

An embodiment where operation S130 is performed after operation S120 is performed is described, but operation S120 and operation S130 may be performed in any order. For example, operation S120 may be performed after operation S130 is performed.

In this case, operation S120 may be performed after operation S130 when pixel data to be received at a next frame are equal to the pixel data received in operation S110. Additionally, operation S140 may be performed after operation S130 when the pixel data to be received at the next frame are different from the pixel data received in operation S110.

Additionally or alternatively, the operation of FIG. 5 may be terminated when the alpha data values received in operation S110 has the reference value determined in operation S120. Operation S140 may be performed when at least one of the alpha data values received in operation S110 does not have the reference value determined in operation S120.

Figure 6:
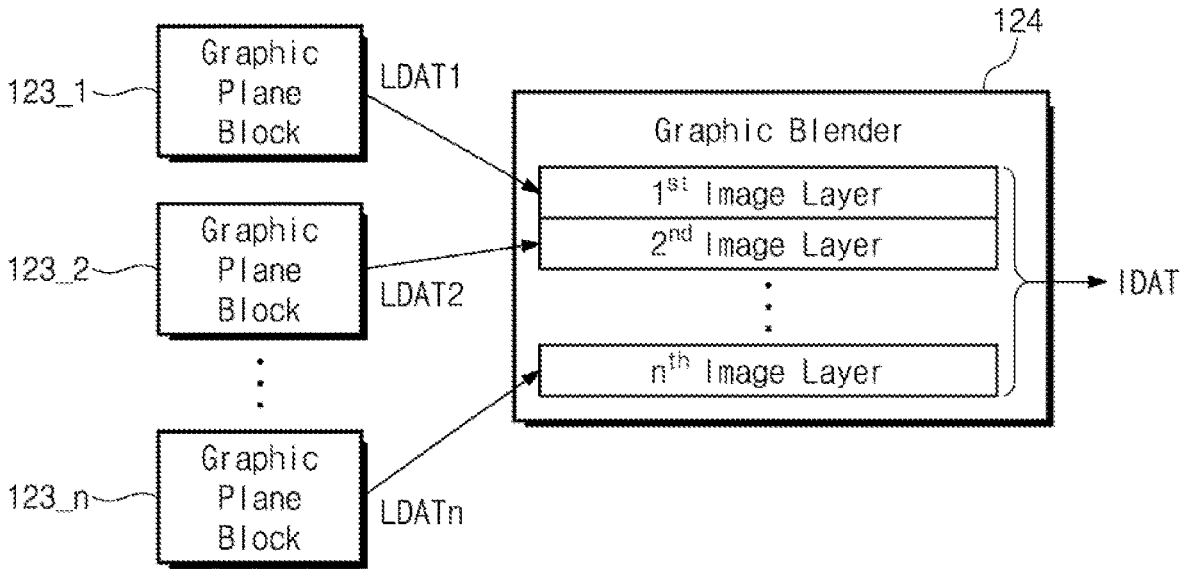
FIG. 6 is a conceptual diagram for describing exemplary operations of a display driver of FIG. 1.

FIG. 6 is a conceptual diagram for describing exemplary operations of a display driver of FIG. 1.

The graphic plane blocks 123_1 to **123_*n* may respectively generate the signals LDAT1 to LDATn indicating image layers based on image data received in compliance with the operations described with reference to FIG. 4. The graphic plane blocks 123_1 to 123_*n* may output the signals LDAT1 to LDATn to the graphic blender 124**.

The graphic blender 124 may blend "n" image layers based on the signals LDAT1 to LDATn. A first image layer to an n-th image layer may correspond to image data respectively obtained based on the signals LDAT1 to LDATn, respectively. The graphic blender 124 may generate new image data based on the first image layer to the n-th image layer.

For example, the graphic blender 124 may generate image data by sorting the first image layer to the n-th image layer according to a sorting order, and blending image layers in the sorting order. The graphic blender 124 may output the signal IDAT indicating the newly generated image data to the panel 130.

For example, the order of sorting the first image layer to the n-th image layer may be defined by a designer. The designer may determine priorities of first image data to n-th image data to be displayed by the panel 130 and may determine an order for sorting the first image layer to the n-th image layer based on the priorities. In a case where priorities are determined in the order from the first image layer to the n-th image layer, a k-th image layer may be displayed by the panel 130 prior to a (k+1)-th image layer to the n-th image layer (k being a natural number of less than (n−1)).

Figure 7:
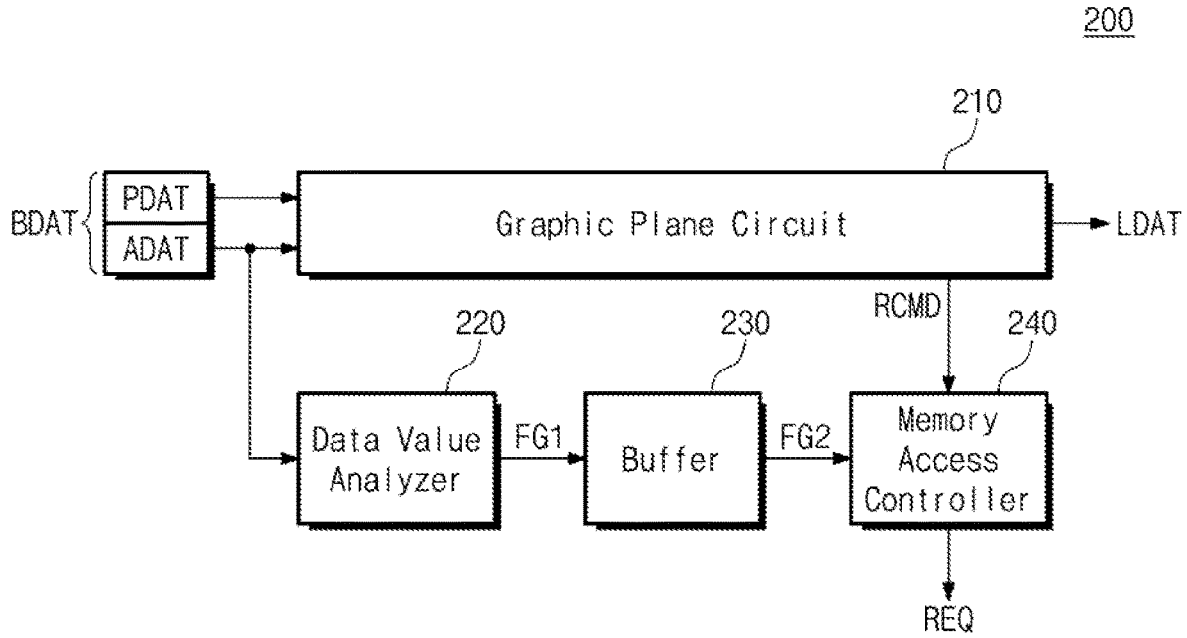
FIG. 7 is a block diagram illustrating an exemplary configuration of each of graphic plane blocks of FIG. 2.

FIG. 7 is a block diagram illustrating an exemplary configuration of each of graphic plane blocks of FIG. 2.

Each of the graphic plane blocks 123_1 to **123_*n* of FIG. 2 may include a graphic plane block 200 of FIG. 7. Referring to FIG. 7, the graphic plane block 200 may include a graphic plane circuit 210, a data value analyzer 220, a buffer 230, and a memory access controller 240**.

The graphic plane block 200 may receive the signal BDAT from the memory 122. The image data BDAT of the signal BDAT may include the data burst including the pixel data PDAT and the alpha data ADAT.

The graphic plane circuit 210 may receive the pixel data PDAT and the alpha data ADAT. The graphic plane circuit 210 may generate an image layer to be used for blending of the graphic blender 124 based on the pixel data PDAT and the alpha data ADAT. For example, the pixel data PDAT may be associated with brightness values of an image layer, and the alpha data ADAT may be associated with transparency of an image layer.

The graphic plane circuit 210 may output the signal LDAT indicating an image layer to the panel 130. Additionally, the graphic plane circuit 210 may output, the memory access controller 240, a signal RCMD for requesting new image data to be used to generate an image layer of a next frame.

The data value analyzer 220 may receive the alpha data ADAT. Additionally, the data value analyzer 220 may receive the change notification data (not illustrated). The data value analyzer 220 may perform operation S120 and operation S130 of FIG. 5. The data value analyzer 220 may generate a signal FG1 indicating data indicating whether to perform operation S140. For example, the data value analyzer 220 may generate the signal FG1 with a first logical value to perform operation S140. Alternatively, the data value analyzer 220 may generate the signal FG1 with a second logical value such that operation S140 is not performed.

The buffer 230 may receive the signal FG1 from the data value analyzer 220. The buffer 230 may generate a signal FG2 corresponding to the signal FG1. For example, the buffer 230 may temporarily store a logical value of the signal FG1. The buffer 230 may generate the signal FG2 indicating the logical value of the temporarily stored signal FG1. The buffer 230 may output the signal FG2 to the memory access controller 240.

The memory access controller 240 may determine whether there is new image data corresponding to a next frame. For example, the memory access controller 240 may determine whether to perform operation S140 of FIG. 5 based on the signal FG2. The memory access controller 240 may output the signal REQ for requesting image data corresponding to the next frame in response to the signal RCMD when new image data corresponding to a next frame is determined. The memory access controller 240 may not output the signal REQ when there is no new image data corresponding to the next frame.

For example, when the signal FG2 has the first logical value, the memory access controller 240 may output the signal REQ for requesting image data corresponding to the next frame in response to the signal RCMD. Alternatively, when the signal FG2 has the second logical value, the memory access controller 240 may not output the signal REQ regardless of receiving the signal RCMD.

According to the operations described with reference to FIG. 7, as the signal REQ is selectively output, the pixel data PDAT corresponding to a certain display region of the panel 130 may not be received by the graphic plane block 200. Accordingly, an image layer indicated by the signal LDAT may not include image data corresponding to the pixel data PDAT not received.

Figure 8:
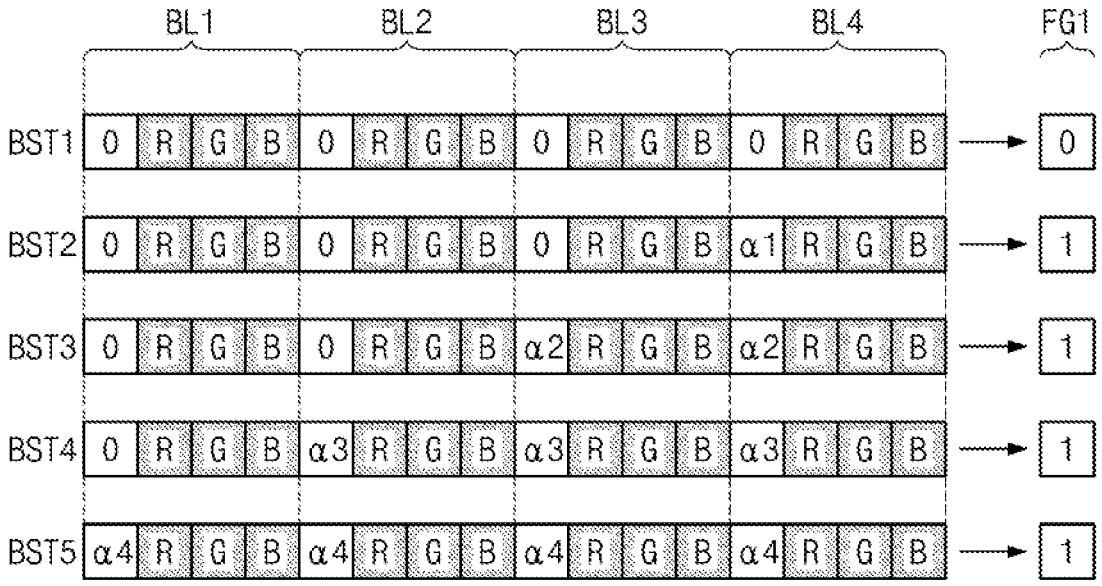
FIG. 8 is a conceptual diagram for describing exemplary operations of a graphic plane block of FIG. 7.

FIG. 8 is a conceptual diagram for describing exemplary operations of a graphic plane block of FIG. 7.

For example, the manner in which a logical value of the signal FG1 is determined based on alpha data is described. As described with reference to FIG. 7, a logical value of the signal FG1 may be determined based on the change notification signal as well as alpha data.

The graphic plane block 200 may obtain data bursts BST1 to BST5 based on the signal BDAT. For example, a channel width between the memory 122 and the graphic plane block 200 may correspond to 4 data blocks BL1 to BL4. In this case, the data value analyzer 220 may sequentially obtain the data bursts BST1 to BST5, each including 4 data blocks BL1 to BL4.

In the example of FIG. 8, the reference value of alpha data may be "0". The alpha data values included in the data burst BST1 may be "0". Accordingly, based on the alpha data of the data burst BST1, the data value analyzer 220 may generate the signal FG1 indicating a first logical value (e.g., a logical value of "0") to request image data of a next frame.

In another example, the alpha data value of the data block BL4 included in the data burst BST2 may be "α1", not "0". Accordingly, based on the alpha data of the data burst BST1, the data value analyzer 220 may generate the signal FG1 indicating a second logical value (e.g., a logical value of "1"). Therefore, image data of a next frame may not be requested.

In another example, the alpha data values of the data block BL3 and block BL4 included in the data burst BST3 may be "α2", not "0". Accordingly, based on the alpha data of the data burst BST2, the data value analyzer 220 may generate the signal FG1 indicating the second logical value (e.g., a logical value of "1"). Therefore, image data of a next frame may not be requested.

In another example, the alpha data values of the data block BL2 to block BL4 included in the data burst BST4 may be "α3", not "0". Accordingly, based on the alpha data of the data burst BST3, the data value analyzer 220 may generate the signal FG1 indicating the second logical value (e.g., a logical value of "1"). Therefore, image data of a next frame may not be requested.

In another example, the alpha data values of the data block BL1 to block BL4 included in the data burst BST5 may be "α4", not "0". Accordingly, based on the alpha data of the data burst BST4, the data value analyzer 220 may generate the signal FG1 indicating the second logical value (e.g., a logical value of "1"). Therefore, image data of a next frame may not be requested.

Figure 9:
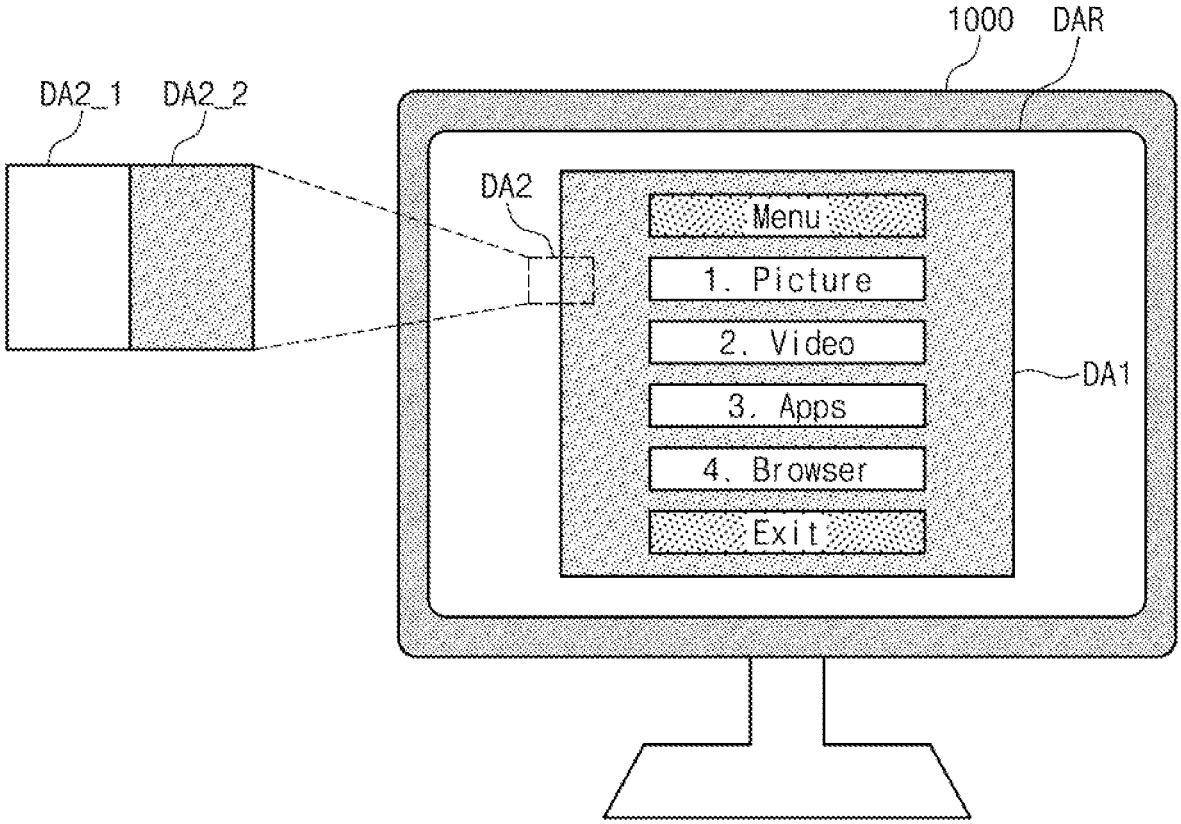
FIG. 9 is a conceptual diagram illustrating an exemplary operation of an electronic device of FIG. 1.

FIG. 9 is a conceptual diagram illustrating an exemplary operation of an electronic device of FIG. 1.

An electronic device 1000 of FIG. 9 may include the electronic device 100 of FIG. 1. For example, the electronic device 1000 may be one of various types of display devices configured to provide image information to the user, like a DTV. The electronic device 1000 may include a display region DAR for displaying an image.

The electronic device 1000 may display an image in a first region DA1 in response to a command of the user. For example, an image of the first region DA1 may correspond to a first image layer, and an image of the remaining region of the display region DAR other than the first region DA1 may correspond to a second image layer. In priorities of a display operation, the priority of the first image layer may be higher than the priority of the second image layer. Accordingly, a portion of the image of the second image layer corresponding to the first region DA1 may not be displayed.

For example, referring to FIG. 2, the first image layer may be generated by the graphic plane block 123_1, and the second image layer may be generated by the graphic plane block 123_2. According to the operations of FIG. 5, the graphic plane block 123_2 may not generate image data associated with the remaining region of the image of the first image layer other than the first region DA1.

Alpha data of a data burst received by the graphic plane block 123_2 may correspond to the reference values (refer to the data burst BST1 of FIG. 8). For example, a first subregion DA2_1 may be a portion of a second region DA2.

For example, with regard to a second subregion DA2_2 being a portion of the second region DA2, alpha data of a data burst received by the graphic plane block 123_2 may have values other than the reference value (refer to the data burst BST5 of FIG. 8).

Accordingly, at least one of alpha data values included in the data burst may not be the reference value when the data burst is received by the graphic plane block 123_2. The data burst may include a portion of the first subregion DA2_1 and a portion of the second subregion DA2_2. For example, where a region corresponding to the data burst includes a boundary between the subregions DA2_1 and DA2_2. In this case, refer to the data bursts BST2 to BST4 in FIG. 8.

Thus, according to another exemplary embodiment, a method of displaying images includes receiving a first alpha data value and a first pixel data value (i.e., for first subregion DA2_1), and a second alpha data value and a second pixel data value (i.e., for second subregion DA2_2) from a memory; determining whether the first alpha data value and the second alpha data value are equal to a reference value; transmitting a request signal to the memory based on the determination, where the request signal indicates a request for a third pixel data value; and generate one or more image layers based on the first alpha data value, the first pixel data value, the second alpha data value, the second pixel data value, the third pixel data value, or any combination thereof.

In some cases, the request signal is transmitted when at least one of the first alpha data value and the second alpha data value is different from the reference value, and the request signal is not transmitted when the first alpha data value and the second alpha data value are both equal the reference value. In some cases, the first alpha data value and the first pixel data value are rendered for a first frame of a first display region (e.g., for a portion of the first subregion DA2_1), the second alpha data value and the second pixel data value are rendered for the first frame of a second display region (e.g., for a portion of the second subregion DA2_2), and the third pixel data value is rendered for a second frame of the first display region.

Figure 10:
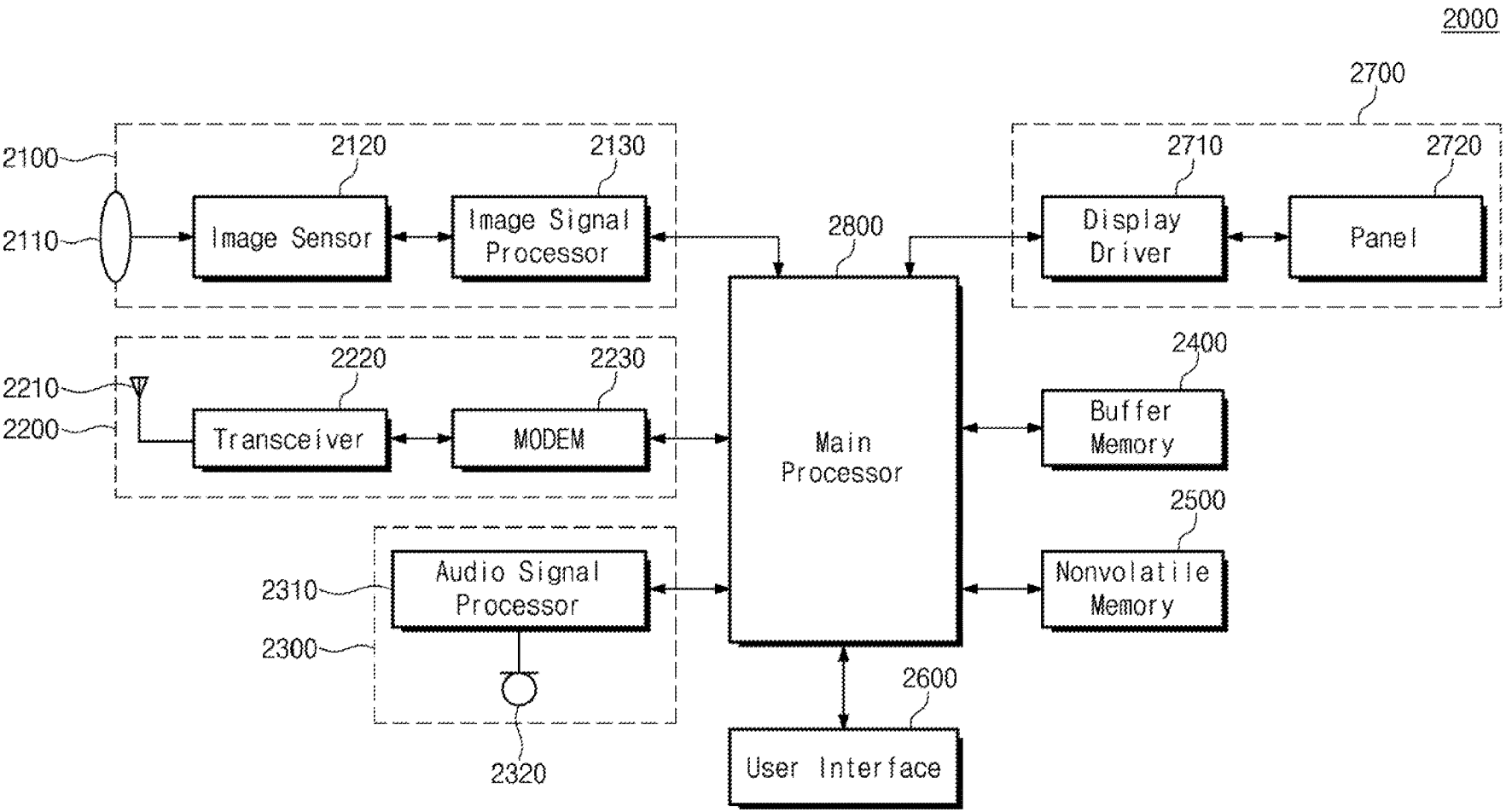
FIG. 10 is a block diagram illustrating an exemplary configuration of an electronic device including an electronic device of FIG. 1.

FIG. 10 is a block diagram illustrating an exemplary configuration of an electronic device, including an electronic device of FIG. 1.

An electronic device 2000 may include an image processing block 2100, a communication block 2200, an audio processing block 2300, a buffer memory 2400, a nonvolatile memory 2500, a user interface 2600, a display block 2700, and a main processor 2800. However, components of the electronic device 2000 are not limited to the embodiment of FIG. 10. The electronic device 2000 may not include one or more of the components illustrated in FIG. 10 or may further include at least one component not illustrated in FIG. 10.

The image processing block 2100 may include a lens 2110, an image sensor 2120, and an image signal processor 2130. Additionally, the image processing block 2100 may receive a light through a lens 2110. The image sensor 2120 may include pixels for photoelectric conversion of the light received through the lens 2110. The image sensor 2120 may include a modulator for converting analog signals generated by the photoelectric conversion to digital signals. The image signal processor 2130 may generate image information associated with an external subject based on the digital signals generated by the image sensor 2120.

The communication block 2200 may include an antenna 2210, a transceiver 2220, and a modulator/demodulator (MODEM) 2230. Additionally, the communication block 2200 may exchange signals with an external device/system through the antenna 2210. The MODEM 2230 may include a modulator for converting an analog signal received through the antenna 2210 to a digital signal.

For example, the transceiver 2220 and the MODEM 2230 of the communication block 2200 may process signals exchanged with the external device/system in compliance with a wireless communication protocol such as long term evolution (LTE), worldwide interoperability for microwave access (WiMax), global system for mobile communication (GSM), code division multiple access (CDMA), Bluetooth, near field communication (NFC), wireless fidelity (Wi-Fi), or radio frequency identification (RFID).

The audio processing block 2300 may include an audio signal processor 2310 and a microphone 2320. Additionally, the audio processing block 2300 may receive an analog audio signal through the microphone 2320. The microphone 2320 may receive an analog audio signal from the outside of the electronic device 2000. The audio signal processor 2310 may include a modulator for converting the analog audio signal received through the microphone 2320 to a digital signal.

The buffer memory 2400 may store data that are used for an operation of the electronic device 2000. For example, the buffer memory 2400 may temporarily store processed, or to be processed, data by the main processor 2800. The buffer memory 2400 may include a volatile memory such as a SRAM, a DRAM, an SDRAM, and/or a nonvolatile memory such as a flash memory, a PRAM, an MRAM, a ReRAM, or a FRAM.

The nonvolatile memory 2500 may store data regardless of power supply. For example, the nonvolatile memory 2500 may include at least one of various nonvolatile memories such as a flash memory, a PRAM, an MRAM, a ReRAM, and a FRAM. The nonvolatile memory 2500 may include a removable memory such as a hard disk drive (HDD), a solid-state drive (SSD), or a secure digital (SD) card, and/or an embedded memory such as an embedded multimedia card (eMMC).

The user interface 2600 may arbitrate communication between a user and the electronic device 2000. The user may input a command to the electronic device 2000 through the user interface 2600. For example, the user may input a command for requesting certain image information through the user interface 2600.

The display block 2700 may include a display driver 2710 and a panel 2720. The display driver 2710 may include the display driver 120 of FIG. 1, and the panel 2720 may include the panel 130 of FIG. 1. To provide an image to the user, the display driver 2710 may output image data to the panel 2720 under control of the main processor 2800. The panel 2720 may provide image information requested from the user based on image data.

The main processor 2800 may control overall operations of the electronic device 2000. For example, the main processor 2800 may include the main processor 110 of FIG. 1. The main processor 2800 may control/manage operations of the components of the electronic device 2000. For example, to provide image information to the user, the main processor 2800 may output a command signal to the display driver 2710 of the display block 2700. The main processor 2800 may process various operations to operate the electronic device 2000. For example, the main processor 2800 may be implemented with a general-purpose processor, a special-purpose processor, or an application processor.

According to some embodiments of the present inventive concept, power consumption of an electronic device for outputting an image is reduced.

While the inventive concept has been described with reference to exemplary embodiments thereof, it will be apparent to those of ordinary skill in the art that various changes and modifications may be made thereto without departing from the spirit and scope of the inventive concept as set forth in the following claims.

What is claimed is:

1. An electronic device comprising:

a memory configured to output a first alpha data value and a first pixel data value rendered for a first frame of a first display region, to output a second alpha data value and a second pixel data value rendered for the first frame of a second display region, and to store a third pixel data value rendered for a second frame of the first display region; and a plane circuit configured to determine whether the first alpha data value and the second alpha data value are equal to a reference value and whether the first pixel data value corresponds to the third pixel data value, and to output a request signal for the third pixel data value based on the determination.

2. The electronic device of claim 1, wherein the first alpha data value is associated with a transparency of an image to be displayed in the first display region based on the first pixel data value.

3. The electronic device of claim 1, wherein the first pixel data value is associated with a color value of an image to be displayed in the first display region.

4. The electronic device of claim 1, wherein the memory is further configured to:

output the third pixel data value in response to the request signal that is output based on the second alpha data value and the second pixel data value.

5. The electronic device of claim 1, wherein the plane circuit is further configured to:

output the third pixel data value in response to the request signal when at least one of the first alpha data value and the second alpha data value is different from the reference value.

6. The electronic device of claim 1, wherein the memory is further configured to:

output the third pixel data value in response to the request signal when the first alpha data value and the second alpha data value are equal to the reference value and the first pixel data value and the third pixel data value are different.

7. The electronic device of claim 1, wherein the plane circuit is further configured to:

output an image layer of the first frame based on the first alpha data value, the first pixel data value, the second alpha data value, and the second pixel data value.

8. The electronic device of claim 7, wherein the image layer includes the first pixel data value and the second pixel data value, depending on whether the first alpha data value and the second alpha data value are equal to the reference value.

9. The electronic device of claim 1, wherein the memory is further configured to:

output the second alpha data value and the second pixel data value such that the second alpha data value and the second pixel data value are respectively matched with the first alpha data value and the first pixel data value.

10. The electronic device of claim 1, wherein the memory is further configured to:

store a fourth pixel data value rendered for the second frame of the second display region.

11. The electronic device of claim 10, wherein the plane circuit is further configured to:

output the request signal further based on whether the second pixel data value corresponds to the fourth pixel data value, and wherein the third pixel data value and the fourth pixel data value are matched to each other in a single unit.

12. An electronic device comprising:

a memory configured to output a first alpha data value and a first pixel data value rendered for a first frame of a first display region, to output a second alpha data value and a second pixel data value rendered for the first frame of a second display region, and to store a third pixel data value rendered for a second frame of the first display region;

a plane circuit configured to output an image layer including the third pixel data value, based on whether the first alpha data value and the second alpha data value are equal to a reference value, wherein the first alpha data value, the first pixel data value, the second alpha data value, and the second pixel data value are output in response to one request signal; and a display panel configured to display an image based at least in part on the image layer.

13. The electronic device of claim 12, further comprising:

a plurality of plane circuits, wherein each of the plurality of plan circuits is configured to output one of a plurality of image layers included in the first frame.

14. The electronic device of claim 13, further comprising:

a blender configured to blend the plurality of image layers.

15. The electronic device of claim 12, wherein the plane circuit is further configured to:

request the third pixel data value when at least one of the first alpha data value and the second alpha data value is different from the reference value.

16. The electronic device of claim 12, wherein the image layer including the third pixel data value is output based on whether the first pixel data value and the third pixel data value are different.

17. An electronic device comprising:

a processing engine configured to render first alpha data values and first pixel data values for a first frame of a target display region and to render second alpha data values and second pixel data values for a second frame of the target display region;

a memory configured to output the first alpha data values and the first pixel data values in response to a first request signal and to output the second alpha data values and the second pixel data values in response to a second request signal;

a plane circuit configured to output the first request signal for requesting the first alpha data values and the first pixel data values in a first time period, and wherein the plane circuit is further configured to output the second request signal in a second time period after the first time period when the first alpha data values are equal to a reference value; and a display panel configured to display an image based at least in part on the first request signal, the second request signal, or both.

18. The electronic device of claim 17, wherein the plane circuit is further configured to:

generate an image layer of the second frame based on the second pixel data values when the first alpha data values are equal to the reference value.

19. The electronic device of claim 17, wherein the memory is further configured to:

output a command signal for controlling the processing engine.

20. The electronic device of claim 19, wherein the processing engine is further configured to:

render the first alpha data values, the first pixel data values, the second alpha data values, and the second pixel data values in response to the command signal.

* * * * *